United States Patent [19]

Goldenberg

[11] 4,390,096

[45] Jun. 28, 1983

[54] DISPOSABLE RAIN PONCHO SYSTEM

[76] Inventor: Frank G. Goldenberg, 3700 Sherwood Pl., Lynchburg, Va. 24503

[21] Appl. No.: 254,023

[22] Filed: Apr. 14, 1981

[51] Int. Cl.[3] ..... B65D 85/66; B65D 85/67; B65D 85/18

[52] U.S. Cl. ..... 206/390; 2/84; 206/820; 206/278; 224/202

[58] Field of Search ..... 206/390, 634, 494, 820, 206/278; 2/84, 88; 224/257, 258, 202

[56] References Cited

U.S. PATENT DOCUMENTS

| | | | |
|---|---|---|---|
| 2,028,825 | 1/1936 | Christensen | 224/202 |
| 2,692,989 | 11/1954 | Jelstrup | 206/634 |
| 2,911,651 | 11/1959 | Nye et al. | 2/84 |
| 3,225,918 | 12/1965 | Mines | 206/390 |
| 3,229,875 | 1/1966 | Stoller | 206/390 |
| 3,665,518 | 5/1972 | Leadford | 2/88 |
| 3,751,323 | 8/1973 | Cowen | 206/494 |
| 3,851,760 | 12/1974 | Smith | 206/390 |

FOREIGN PATENT DOCUMENTS

| | | | |
|---|---|---|---|
| 391507 | 6/1908 | France | 224/257 |

*Primary Examiner*—William T. Dixson, Jr.
*Attorney, Agent, or Firm*—Griffin, Branigan & Butler

[57] ABSTRACT

A disposable rain poncho system includes a string of ponchos, frangibly interconnected, and arranged in a roll. The roll is mounted on a dispenser which allows access to an end poncho of the string whereby that poncho can be unrolled from the roll and torn from an adjacent poncho. The dispenser is mounted on a shoulder strap for enabling a vendor, or the like, to carry the dispenser while dispensing rain ponchos. The roll is shorter than the width of the ponchos, and the string of ponchos is, therefore, folded along at least one longitudinal crease.

7 Claims, 4 Drawing Figures

FIG. 1
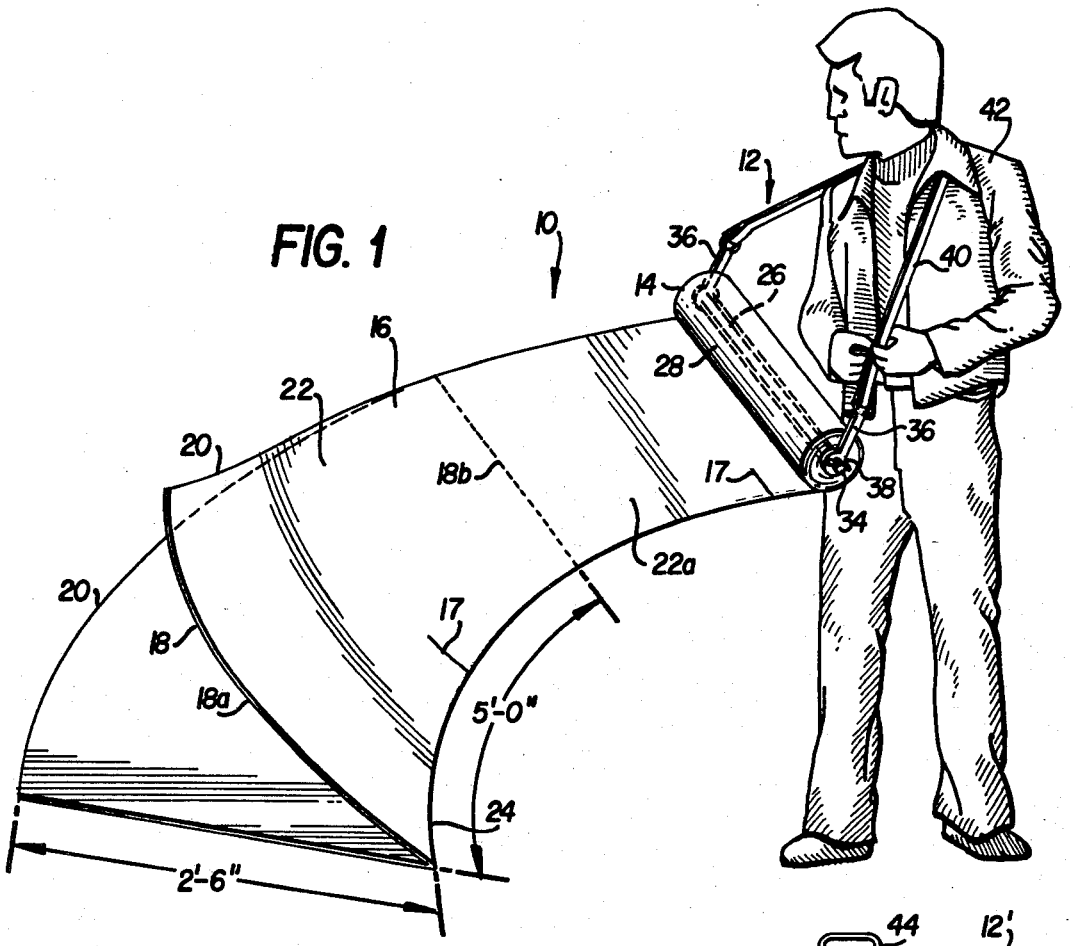
FIG. 2
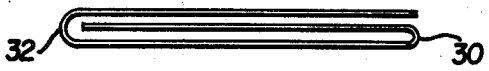
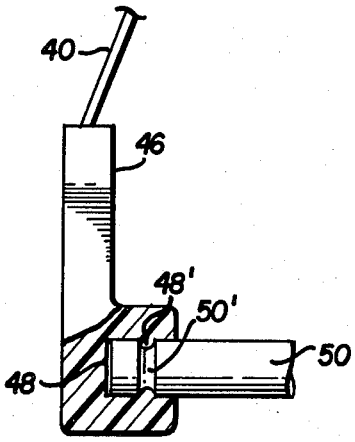
FIG. 4
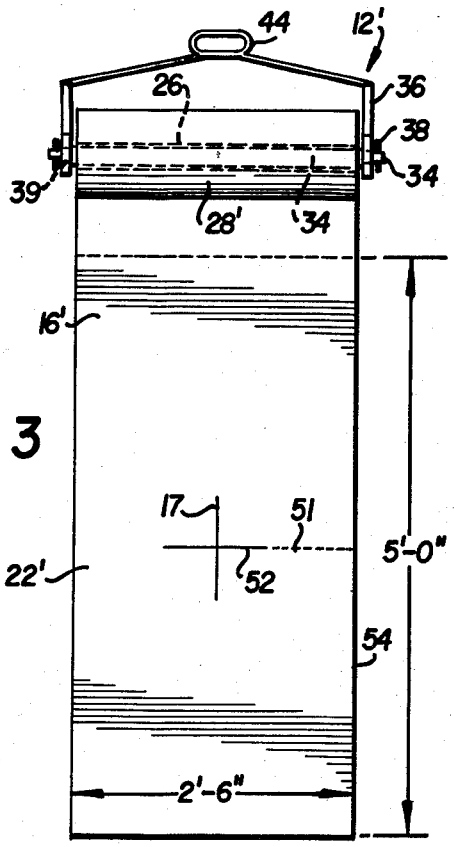
FIG. 3

DISPOSABLE RAIN PONCHO SYSTEM

BACKGROUND OF THE INVENTION

This invention relates broadly to the art of foul weather clothing, and more particularly to disposable ponchos.

As used herein, a poncho refers to a cloak resembling a blanket with an opening approximately in the middle for receiving a head. Because this invention relates to waterproof ponchos, worn chiefly as a raincoat or a windbreaker, the word poncho, as used herein, is synonomous with with a waterproof poncho.

Ponchos are used by military personnel, campers, and the like to protect them from wind and rain. Ponchos are particularly advantageous for travelers because, since they are flat, they can be folded into small packages and, therefore, easily stored. Campers particularly like ponchos because they can be strung between poles, or trees, to form shelters.

Inexpensive ponchos have been distributed at gatherings, such as sporting events, when inclimate weather has suddenly sprung up.

U.S. Pat. No. 3,665,518 to Leadford relates to a disposable rain poncho which may be easily folded into a small packet and carried in a pocket or purse at all times. In event of need, the packet is opened, the poncho used, and then simply discarded. A difficulty with such ponchos is that it is inconvenient to carry them around at all times until they are needed because they take up useful space in purses and pockets. It is therefore an object of this invention to provide a disposable-poncho system which makes ponchos available to those in a crowd, but does not require each individual to carry a poncho in his respective purse, pocket, and the like.

It is an object of this invention to provide a disposable-poncho system which:

(1) is inexpensive to manufacture;

(2) allows vendors at outdoor sporting events, and the like, to easily store ponchos until they are needed, and once they are needed, to readily dispense and sell individual ponchos to customers in a crowd; and (3) provides a disposable-poncho system which makes ponchos available inexpensively to large groups of people.

SUMMARY

According to principles, of this invention, thin, waterproof ponchos are arranged in a string, with adjacent ponchos being frangibly attached to one another. The poncho string is folded on a longitudinal crease and thereafter rolled from one end of the string, with the other end being accessible. The roll is then mounted on a dispenser which allows the roll to be rotated, so that the outer end of the string can be easily unwound from the roll by rotating the roll. The outer-most poncho can be ripped off the string at its frangible connection with the adjacent poncho, to be distributed.

In one described embodiment, the ponchos are rectangular in shape, being relatively narrow, and are therefore not folded on a longitudinal crease. In another described embodiment they are folded once.

In still another described embodiment, the poncho string is folded more than once along longitudinal creases.

BRIEF DESCRIPTION OF THE DRAWINGS

The foregoing and other objects, features and advantages will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is an isometric view of an individual carrying a first-embodiment system for dispensing disposable rain ponchos according to principles of this invention;

FIG. 2 is a sectional view of a second-embodiment system showing longitudinal folds and longitudinal creases in a poncho string;

FIG. 3 is a plan view of a third embodiment system for dispensing disposable rain ponchos according to principles of this invention wherein the rain poncho string is not folded along a longitudinal crease; and, FIG. 4 is a side segmented view of a portion of a second-embodiment dispenser according to principles of this invention.

DESCRIPTION OF THE PREFERRED EMBODIMENT

In FIG. 1, a disposable-rain-poncho-dispensing system 10 comprises a dispenser 12 and a roll of disposable rain ponchos 14.

The roll of disposable rain ponchos 14 is comprised of a string 16 of rain ponchos, each having a head opening 17 in the form of crossed slits, which are connected end-to-end to adjacent ponchos. That is, each poncho has two end edges 18, and two side edges 20. In the preferred embodiment, the end edges are approximately five feet in length and the side edges are also approximately five feet in length, thus, the ponchos are approximately square. In any respect, a particular poncho 22 was attached along its first end edge **18*a* with a frangible attachment to an adjacent poncho (not shown because it has been torn away) and it is still attached along a second end edge 18*b* by a frangible connection to an adjacent poncho 22*a***.

With regard to the frangible attachments, these attachments are formed as perforate lines so that the poncho 22 can be easily ripped from the poncho **22*a* along the frangible edge 18*b*. As a practical matter, in the preferred embodiment, the string of ponchos 16 is constructed of a single piece of material with perforate lines between ponchos to form the end edges 18*a*, and 18*b***.

The poncho string 16, and therefore each individual poncho 22, is formed of a sheet of light gauge polyethylene of a thickness of approximately 0.005 inches.

In the FIG. 1 embodiment, it can be seen that the poncho string 16 is folded along a longitudinally diposed crease 24 on itself and then, starting at the end (not shown) opposite the end edge **18*a*, the string 16 is rolled onto a cylindrical core 26, which in the preferred embodiment is similar to a toilet paper core, to form a roll 28. Since the string was folded on itself along the longitudinally disposed crease 24, the roll 28 is only half as wide (two and one-half feet) as the width of the ponchos in the string 16**.

In another embodiment, as is depicted in FIG. 2, the string 16 is folded on itself twice, along two longitudinal creases 30 and 32, so that the roll 28 can be even narrower.

In the FIG. 3 embodiment, a string 16' is not folded at all along a longitudinal crease, and therefore a roll 28' is just as wide as the string 16'. The FIG. 3 embodiment is practiced where the ponchos are rectangular in shape, being much longer than they are wide. In the FIG. 3 embodiment, for example, the ponchos are five feet long, but only two and one-half feet wide. Thus, in the FIG. 3 embodiment, the roll 28' is two and one-half feet long.

Describing next the dispenser, or carrier 12, with reference to FIGS. 1 and 3 for descriptions of elements having like reference numerals, this item is formed of a rigid shaft 34 which is of a size to be longer than the roll 28, and receivable through the opening in the cylindrical core 26.

Rigid members 36 are attached to the rigid shaft 34 on opposite sides of the roll 28 by means of pins 38. Such mounting, is rather rigid, due to the closeness of fit between holes 39 in the rigid members 36 and the rigid shaft 34. This closeness of fit and the shape of the rigid shaft 34 prevent the rigid members 36 from either moving inwardly, or angling inwardly, and thereby squeezing the poncho roll 28. Attached to the other ends of the rigid members 36 is a flexible shoulder strap 40 to go around a person's shoulder 42 for carrying the dispenser 12, and the mounted roll 28.

In use, rolls 28 of disposable poncho strings, are sold wrapped about cores 26. When someone desires a dispense ponchos in a crowd, he removes a pin 38, and slips the respective rigid member 36 from the shaft 34. He thereafter inserts the shaft 34 through the core 26 of a roll of ponchos. Thereafter, the individual again mounts the rigid member 36 on the shaft 34 and places the flexible shoulder strap 40 on his shoulder to carry the roll 28 of ponchos. When the individual desires to dispense a poncho, he, or a custormer, grips the outermost end 18*a* of poncho 22 and pulls it, thereby rotating the roll 28 on the shaft 26 to unwrap the poncho 22 from the roll 28. Once the poncho 22 has been totally unwrapped from the roll, either the vendor, or the customer, grips both the fully unwrapped poncho 22, and the next poncho 22*a*, and rips them apart along frangible end edge 18*b*. Thus, the end poncho 22 has been easily dispensed while keeping the vendor's hand free for receiving money, making change, waving an advertisement, etc.

It will be greatly appreciated by those skilled in the art, that rolls 28 of ponchos can be easily stored until they are ready for use.

Although the dispensing system for disposable ponchos of FIG. 1 has been described in relation to a vendor, it will be understood that it could also be used at church picnics, and the like, where money is pooled to take care of accessories. Other potential uses include scout troops who wish to have ponchos available when scouts have forgotten theirs and rain gear is essential. In such a situation as a scout troop outing, a scout master can maintain control over the roll 28 to control dispensing of ponchos and thereby assure that they are not wastefully used.

In the FIG. 3 embodiment, a dispenser 12' is shown having a handle 44 rather than a shoulder strap 40, however, in other respects, it functions essentially the same as the dispenser 12 of FIG. 1.

FIG. 4 depicts another embodiment of the dispenser wherein a rigid member 46 is constructed of molded plastic to have a cavity 48 for tightly receiving a rigid shaft 50 on which the cylindrical core 26 is mounted. In one embellishment of this embodiment there is a bead 48' molded on the inside surface of the cavity 48 which snaps into a groove 50' on the shaft 50 for preventing these two members from separating. The shoulder strap 40 is the same in this embodiment as in the FIG. 1 embodiment.

FIG. 3 depicts another modification of this invention which includes a perforate line 51 extending from a laterally-oriented slit 52, forming the head opening 17, to a side edge 54. The perforate line 51 allows a user to easily rip: (1) an arm opening, or (2) a complete opening extending from the side edge 54 to the lateral slit 52 in poncho 22', and thereby convert the poncho 22' into a cape. Of course this modification can also be incorporated into the ponchos 22 of FIG. 1.

While the invention has been particularly shown and described with reference to preferred embodiments, it will be understood by those skilled in the art that various changes in form and detail may be made therein without departing from the spirit and scope of the invention. For example, the ponchos do not have to be constructed of polyethylene, because many other weather-resistent materials will also suffice. Various size ponchos and folding arrangements could be utilized in the practive of this invention. The slits forming the head openings 17 can be cut with circles at their ends in order to distribute stress thereat and thereby prevent further ripping.

The embodiments of the invention in which an exclusive property or privilege are claimed are defined as follows:

1. A system for dispensing disposable rain garments comprising:

a plurality of rain garments, each of said rain garments being constructed of flexible, water-resistant, material having two end edges and side edges;

said rain garments being frangibly attached at the end edges thereof to end edges of adjacent rain garments, to form a string of attached rain garments having first and second extreme ends from which individual rain garments can be ripped, said rain garment string being wrapped into a roll with said first extreme end being exterior of said roll and said second end being inside said roll; and a dispenser means for mounting said rain-garment-string roll to allow access to the first-extreme-end rain garment and to allow said roll to be turned to thereby rotate the first-extreme end rain garment from said roll, so that said first-extreme-end rain garment can be ripped from said string along its frangible attachment to an adjacent rain garment, said dispenser means including a shoulder strap for allowing an individual to carry it around while walking and for allowing relatively-free unrolling of rain garments therefrom while being thusly carried by said shoulder strap.

2. A system for dispensing disposable rain garments as in claim 1 wherein said rain garments are ponchos, each of said ponchos being constructed of a single flat sheet of flexible, water-resistant, material having two ends edges and side edges, each of said ponchos having an openig therein for allowing the head of a wearer to pass therethrough.

3. A system for dispensing disposable ponchos as in claim 2 wherein said string of attached ponchos is folded on itself at least once along a longitudinally oriented crease.

4. A system for dispensing disposable ponchos as in claim 3 wherein said roll is approximately two feet long while the width of said ponchos are at least five feet.

5. A system for dispensing disposable ponchos as in claim 3 wherein said roll is at least two and one-half feet long and the width of said ponchos is at least five feet.

6. A system for dispensing disposable ponchos as in claim 2 wherein each of said ponchos further includes a laterally oriented perforate line extending from said head opening means to a side edge of said poncho.

7. Disposable rain garments comprising:

a plurality of rain garments each of said rain garments being constructed of flexible, water-resistant, material having two end edges and side edges;

said rain garments being frangibly attached at the end edges thereof to end edges of adjacent rain garments, to form a string of attached rain garments having first and second extreme ends from which individual rain garments can be ripped, said rain garment string being wrapped into a roll with said first extreme end being exterior of said roll and said second end being inside said roll, said rain garments being ponchos, each of said ponchos being constructed of a single flat sheet of flexible, water-resistent, material having two end edges and side edges, each of said ponchos having an opening means spaced from said end and side edges for allowing the head of the wearer to pass therethrough and further including a laterally oriented perforate line extending from head opening means to a side edge of said poncho.

* * * * *

UNITED STATES PATENT AND TRADEMARK OFFICE

CERTIFICATE OF CORRECTION

PATENT NO. : 4,390,096

DATED : June 28, 1983

INVENTOR(S) : Frank G. Goldenberg

It is certified that error appears in the above—identified patent and that said Letters Patent is hereby corrected as shown below:

Col. 1, line 14, delete "with" (first occurrence only).
Col. 1, line 50, delete the comma following the word "principles".
Col. 3, line 28, change "a" to -- to --.

Signed and Sealed this

*Thirteenth* Day of *September 1983*

[SEAL]

*Attest:*

GERALD J. MOSSINGHOFF

*Attesting Officer*

*Commissioner of Patents and Trademarks*